US010655377B2

(12) United States Patent
Goetzelmann

(10) Patent No.: US 10,655,377 B2
(45) Date of Patent: May 19, 2020

(54) METHOD AND SYSTEM FOR DETECTING AN OBSTRUCTION OF A PASSENGER DOOR

(71) Applicant: Westinghouse Air Brake Technologies Corporation, Wilmerding, PA (US)

(72) Inventor: Alan David Goetzelmann, Wheeling, IL (US)

(73) Assignee: WESTINGHOUSE AIR BRAKE TECHNOLOGIES CORPORATION, Wilmerding, PA (US)

( * ) Notice: Subject to any disclaimer, the term of this patent is extended or adjusted under 35 U.S.C. 154(b) by 7 days.

(21) Appl. No.: 15/491,495

(22) Filed: Apr. 19, 2017

(65) Prior Publication Data

US 2017/0306681 A1 Oct. 26, 2017

Related U.S. Application Data

(60) Provisional application No. 62/325,623, filed on Apr. 21, 2016.

(51) Int. Cl.
*E05F 15/40* (2015.01)
*E05F 15/41* (2015.01)
*E05F 15/75* (2015.01)

(52) U.S. Cl.
CPC ..... *E05F 15/41* (2015.01); *E05F 15/40* (2015.01); *E05F 15/75* (2015.01); *E05Y 2400/554* (2013.01); *E05Y 2900/51* (2013.01)

(58) Field of Classification Search
None
See application file for complete search history.

(56) References Cited

U.S. PATENT DOCUMENTS 4,746,845 A * 5/1988 Mizuta ..... H02H 7/0851 318/266
5,069,000 A * 12/1991 Zuckerman ..... B60J 5/06 49/214
5,701,063 A * 12/1997 Cook ..... H02H 7/0851 318/265
5,929,580 A 7/1999 Mullet et al.
(Continued)

FOREIGN PATENT DOCUMENTS

DE 3921158 A1 1/1991
DE 10141557 A1 3/2003
(Continued)

OTHER PUBLICATIONS

EPO Communication Pursuant to Article 94(3) EPC, dated Sep. 9, 2019, 4 pages.

*Primary Examiner* — Bentsu Ro
(74) *Attorney, Agent, or Firm* — Christopher R. Carroll; The Small Patent Law Group LLC

(57) ABSTRACT

A method of detecting an obstruction of a passenger door on a public transit vehicle comprising the steps of: recording the profile of the actuator (motor) current vs. door position following initiation of an opening or closing of the door; based on the recorded profile of actuator current vs. door position acceptable increase in motor current for one or more discrete positions following initiation of opening or closing the door indicative of no obstruction; and comparing an instant current profile to the acceptable increase and indicating a potential door obstruction if the current exceeds the acceptable increase.

20 Claims, 4 Drawing Sheets

(56) References Cited

U.S. PATENT DOCUMENTS

| | | | |
|---|---|---|---|
| 6,636,814 | B1 | 10/2003 | MuCullers et al. |
| 7,119,508 | B2 | 10/2006 | Kurosawa et al. |
| 7,143,743 | B2 | 12/2006 | Uda et al. |
| 7,339,335 | B2 | 3/2008 | Huang et al. |
| 7,342,370 | B2 | 3/2008 | Greene et al. |
| 7,443,642 | B2 | 10/2008 | Dooley |
| 7,498,755 | B2 | 3/2009 | Julicher et al. |
| 7,989,203 | B2 | 8/2011 | Albert et al. |
| 7,999,498 | B2 | 8/2011 | Gotz et al. |
| 8,248,018 | B2 | 8/2012 | Maekawa et al. |
| 8,278,862 | B2 | 10/2012 | Coleman et al. |
| 2005/0122076 | A1 | 6/2005 | Patchell et al. |
| 2005/0151495 | A1 | 7/2005 | Miyauchi |
| 2010/0242368 | A1 | 9/2010 | Yulkowski |

FOREIGN PATENT DOCUMENTS

| | | | |
|---|---|---|---|
| EP | 1580861 | A2 | 9/2005 |
| WO | 0134446 | A1 | 5/2001 |

* cited by examiner

METHOD AND SYSTEM FOR DETECTING AN OBSTRUCTION OF A PASSENGER DOOR

CROSS REFERENCE TO RELATED APPLICATIONS

This application claims the benefit of U.S. Provisional Patent Application No. 62/325,623, filed on Apr. 21, 2016, the disclosure of which is hereby incorporated by reference in its entirety.

BACKGROUND OF THE INVENTION

Field of the Invention

This invention pertains to detecting an obstruction of a passenger door in a transit vehicle.

SUMMARY OF THE INVENTION

Briefly according to this invention, there is provided a method of detecting an obstruction of a passenger door on a public transit vehicle wherein the door operator is, for example, a brushed direct current electrical motor. The method comprises: repeatedly recording the profile of the motor current vs. door position as function, for example, of total motor rotations following initiation of an opening or closing of the door; based on the recorded profiles of motor current vs. door position establishing an acceptable increase in motor current for one or more discrete positions following initiation of opening or closing the door indicative of no obstruction; and comparing an instant current to the acceptable increase and indicating a potential door obstruction if the current exceeds the acceptable increase.

BRIEF DESCRIPTION OF THE DRAWINGS

Further features and other objects and advantages will become apparent from the following detailed description with reference to the drawings wherein.

DESCRIPTION OF THE INVENTION

Figure 1:
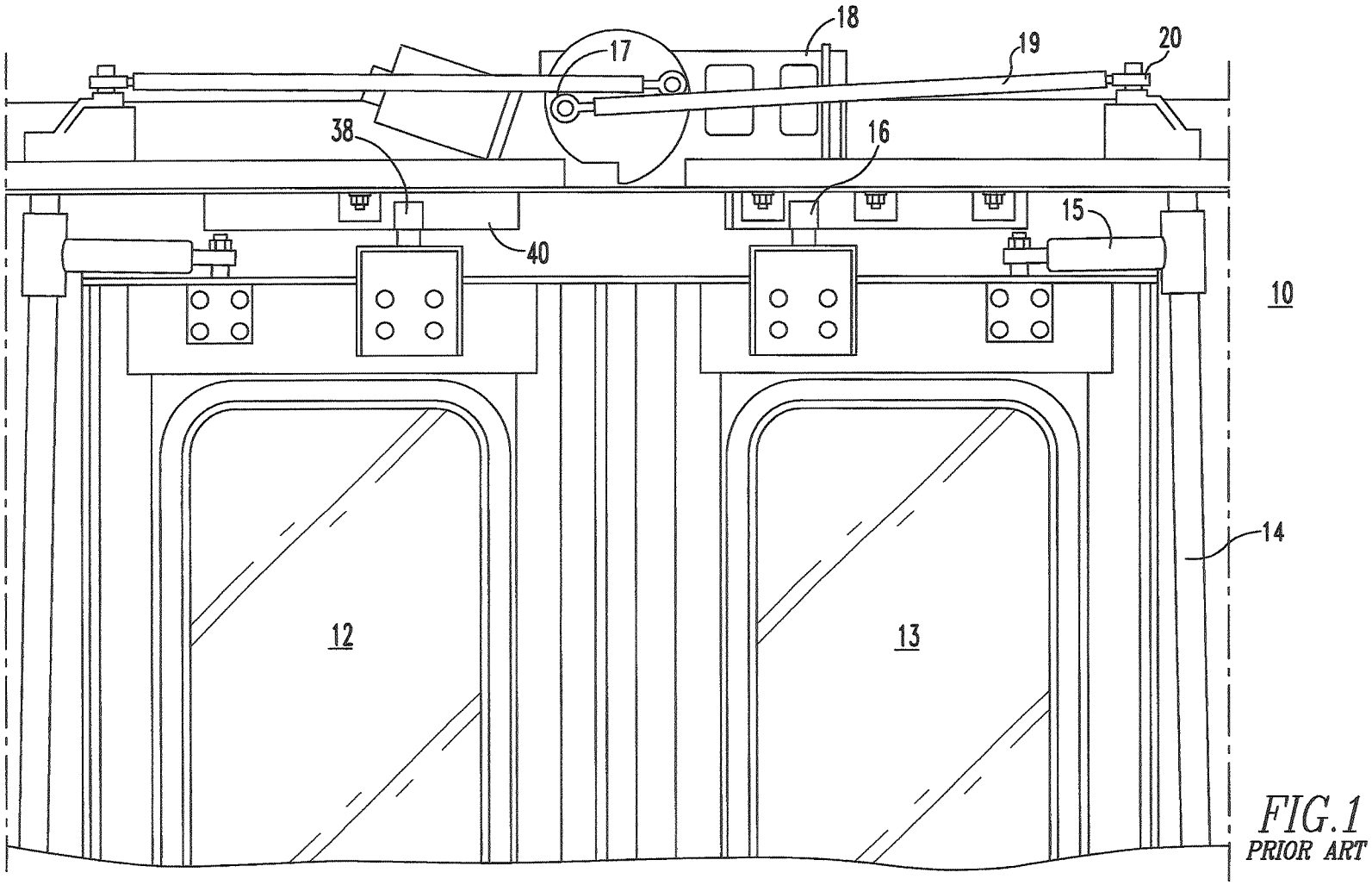
FIG. 1 PRIOR ART
FIG. 1 shows the arrangement of an exemplary prior art transit door.

Referring now to FIG. 1, there is shown the inside of a transit vehicle wall 10 with transit vehicle door panels 12, 13. There are several well-known types of doors used in transit vehicles referred to as slide-glide doors, swing doors, parallel plug doors, and outside plug doors all generally used for bus applications. Also, well-known are slide-glide and bi-fold doors used on light rail trains. Common to all types of transit vehicle doors is a vertical shaft 14 journaled to the wall near an edge of the door panel when the door is closed. The shaft is connected to the door panel by one or more arm assemblies such that rotation of the shaft results in opening or closing of the door. A mechanical door operator 18 comprising a brushed DC motor is connected to rotate the shaft when a door open or close signal is provided.

This invention is not limited to any particular type of transit door but, for purposes of explanation, FIG. 1 illustrates a prior art double slide-glide door. Door panels 12, 13 have a pivotal connection at the top edge near the leading edge (when the door is opening) to an arm assembly 15. The door panels are also hung from a follower 16 near the trailing edge of the door panel that slides in guide track 17 secured above the top edge of the door panel. When the shaft 14 is rotated to pull the door panel inward, the door glides to a position perpendicular to the door opening with the leading edge of the door pointing inwardly. Typically, mounted above the top edge of the door panel is a mechanical door operator 18 for driving connecting rods 19 which, in turn, drives cranks 20, thus rotating the shaft 14.

Figure 2:
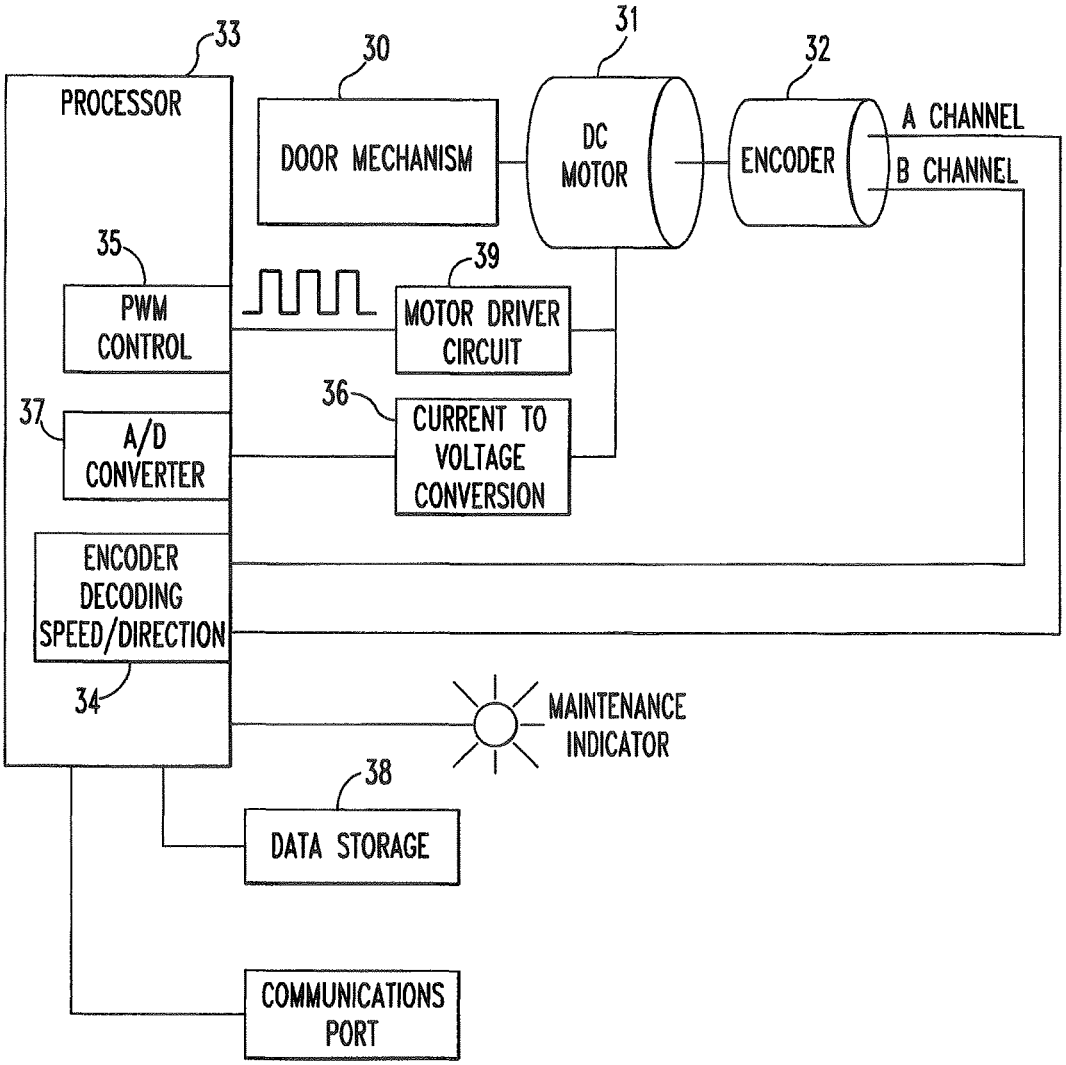
FIG. 2 is a schematic diagram showing the features of the apparatus and circuitry for practicing this invention.

Referring to FIG. 2, the door mechanism 30 comprises connecting rods, cranks, and a rotating door shaft, caused to move the door panel between open and closed position by a direct current brushed electric motor 31. The output shaft of the electric motor is attached to a rotary encoder 32. The rotary encoder outputs two square waves (A and B) that are 90 degrees out of phase. The encoder outputs a fixed number of pulse per rotation. As is well understood in the art, the A and B pulses, when input to a computer 33, can be used by a decoder program 34 to determine the angle of rotation, and the rotational speed and direction of rotation.

The motor 31 is a brushed DC motor. Its direction and speed is controlled by the DC current applied to the motor windings by a driver circuit 39. The driver circuit is, in turn, controlled, for example, by a pulse width modulated (PMW) control program 35 of a computer 33.

The motor current applied to the motor is sensed and converted to a voltage signal at 36 that is digitized by the analog to digital input function 37 of the computer. The digitized current is stored in a computer memory 38 to build motor current profiles vs. door position following the opening or closing of the door. The digitized current may be stored for one or more discrete positions between opened and closed. The motor current profile may be continually adjusted, for example, by calculating an average of a prior established motor current profile (reference current draw value) and a real-time current draw value indicative of obstruction free operation.

Motor torque is motor current or load related. Applied motor voltage determines speed. Motor rotational speed is self-adjusting until just enough current flows to meet torque requirements. If the load torque increases, the motor will slow enough so that the resulting back emf will allow the current to increase sufficiently to carry the load. Changing motor current is indicative of changing load torque.

According to one embodiment of this invention, when the door is moved from open to close or close to open, the motor current data will be recorded in a table. This learned data represents the motor torque that is required at any point in the move operation. Due to speed changes or mechanical irregularities, the motor current may vary even when the door is unobstructed. Also, with various door types, as a result of changing mechanical advantage of the system due the linkages, the required torque can vary during door movement. Constant motor torque does not translate into constant door force and speed.

Figure 5:
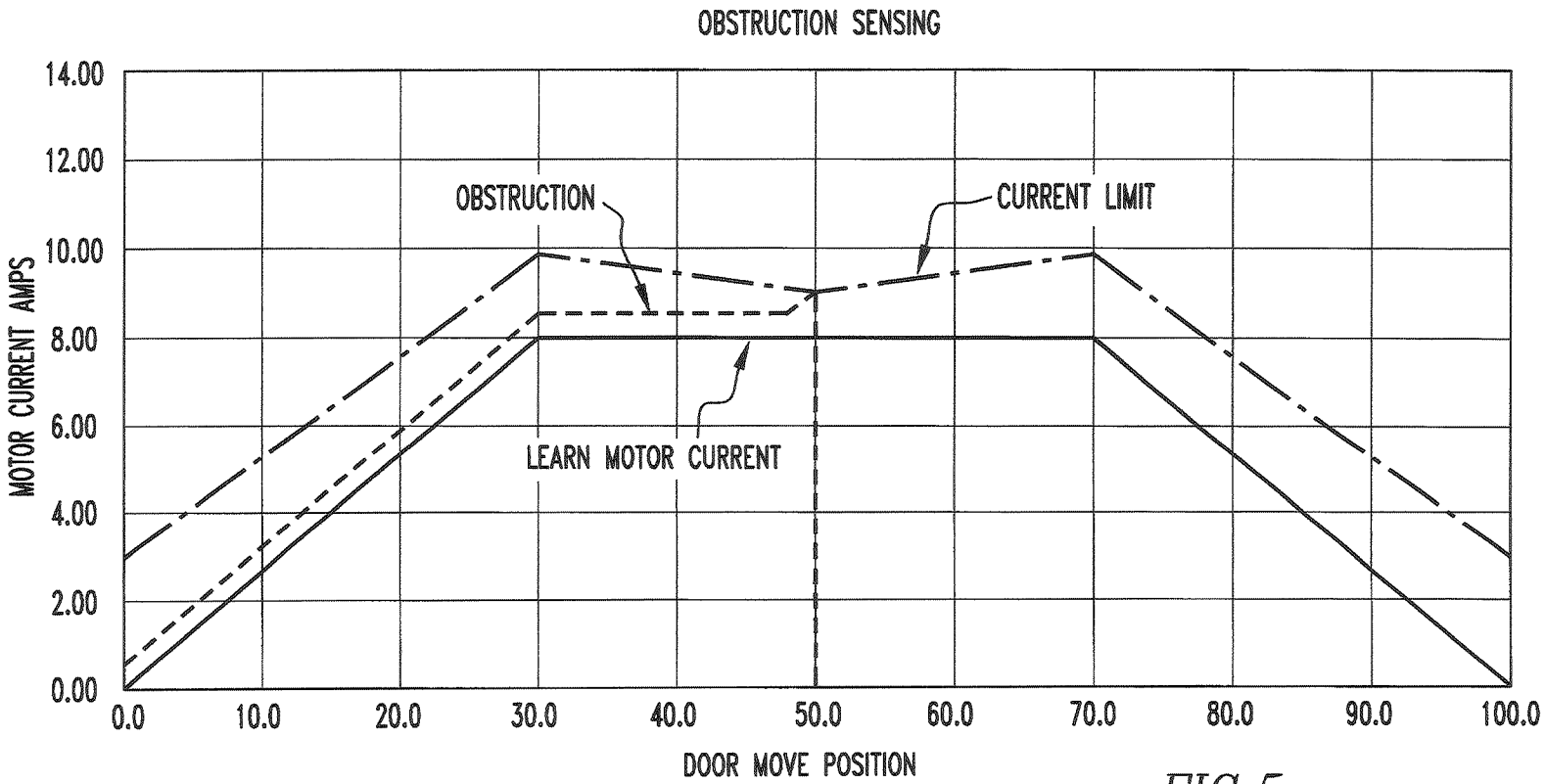
FIG. 5 is a chart showing motor current vs. door position.

FIG. 5 (solid line) shows a learned table in graph form of motor current vs. door position for a hypothetical door. The current rises from zero at a uniform rate as the door is moving to its targeted speed, remains constant for stretch of movement, and then drops off at a uniform rate as the speed is reduced approaching the final position. The motor current increases to 8 amps, levels off, and then decreases. Based on this table, a second table is created establishing the current limit for each position of the door. An offset current (acceptable limit or threshold) is added to the learned current for each position of the door to establish the current limit (dash-dot line). In FIG. 5, the initial offset is 3 amps and diminishes to 2 amps approaching the targeted speed. As the door nears the center position, the offset drops to 1 amp. The current limit is the current above which an obstruction is deemed to have been encountered. Thus, a smaller increase in motor current is needed to trigger an obstruction when the door is near the center position. A hypothetical motor current, in which an obstruction is detected, is illustrated in FIG. 5 (dashed line). It is an advantage of this invention that the offset current can be varied during door movement and made appropriate to the particular type of door mechanism. It is also an advantage, according to this invention, that the offset current acceptable limit, or threshold, may be adjusted based on changing conditions or life of the door, the actuator, or the transit vehicle during usage or the last performed maintenance cycle.

Figure 3:
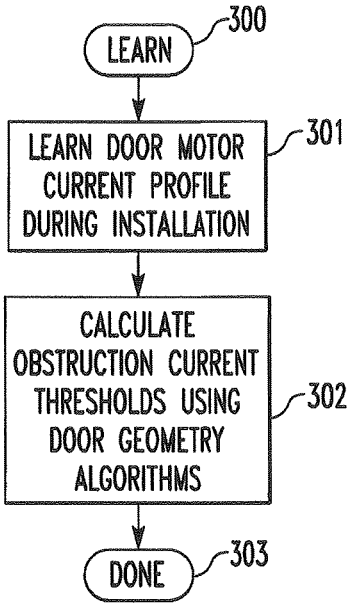
FIGS. 3 and 4 are high level flow diagrams for the computer program used to implement this invention.

Referring now to FIG. 3, a flow diagram is shown for a computer program that controls learning the door motor current profile. After start 300, the door motor current is recorded vs. door position as the door is opened and closed 301. Then, obstruction current thresholds are entered considering door geometry 302. The procedure is then complete 303.

Figure 4:
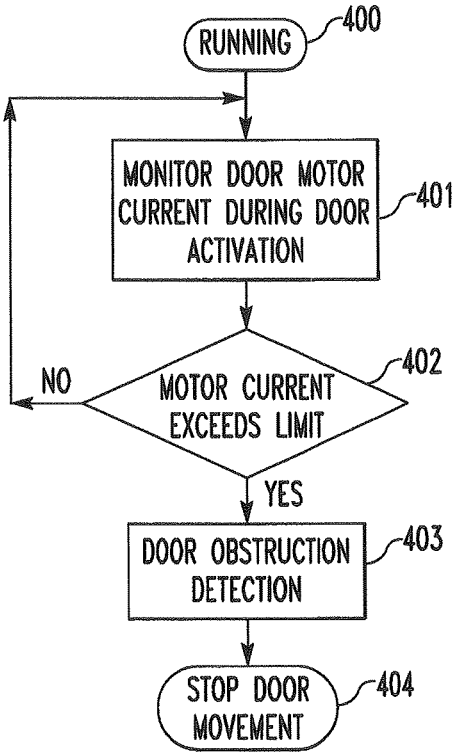

Referring now to FIG. 4, a flow diagram is shown for a computer program for monitoring door motor current. If the door is being moved 400, the door current at each door position is input 401. At each position, the door motor current is compared with the obstruction current threshold for that position 402. If the threshold is not exceeded, control loops back. However, if the threshold is exceeded, a door obstruction is deemed detected 403 and an output commands the door to be stopped by cutting off current to the door motor 404.

Having thus defined the invention in the detail and particularity required by the Patent Laws, what is desired protected by Letters Patent is set forth in the following claims.

The invention claimed is:

1. A method for detecting an obstruction against a door, the method comprising the steps of:

sensing an instantaneous current drawn value by an electric door actuator during movement of the door at one or more discrete positions between fully open and fully closed states of the door;

comparing the instantaneous current drawn value against a reference current drawn value for the electric actuator at each of the one or more discrete positions between the fully open and fully closed states of the door, the reference current drawn value being indicative of an obstruction free operation of the door; and indicating a potential obstruction when the instantaneous current drawn value exceeds the reference current drawn value by a threshold at any of the discrete positions of the door between the fully open and fully closed states;

wherein the reference current drawn value indicative of the obstruction free operation of the door is determined by:

measuring the instantaneous current drawn value by the electric actuator during an open or a close operation of the door at the one or more discrete positions between the fully open and fully closed states; and storing the current drawn value for each of the one or more discrete positions between the fully open and fully closed states when the entire movement of the transit door between the fully open and fully closed states is indicative of an obstruction free operation.

2. The method of claim 1, further comprising establishing a new reference current drawn value at each of the positions between the fully open and fully closed states by calculating an average of the prior established reference current drawn value and the current drawn value indicative of the obstruction free operation for each position between the fully open and fully closed states.

3. The method of claim 2, further comprising utilizing the new reference current drawn value as the reference current drawn value for any subsequent calculation to determine the obstruction at positions between the fully open and fully closed states.

4. The method of claim 2, wherein the door is on a transit vehicle and comprises plural linked door panels.

5. The method of claim 2, further comprising altering a direction of movement of the door when the potential obstruction is indicated.

6. The method of claim 1, further comprising reversing a direction of movement of the door when the potential obstruction is indicated.

7. The method of claim 1, wherein the door is on a transit vehicle and comprises plural linked door panels.

8. A method for detecting an obstruction against a door, the method comprising the steps of:

sensing an instantaneous current drawn value by an electric door actuator during movement of the door at one or more discrete positions between fully open and fully closed states of the door;

comparing the instantaneous current drawn value against a reference current drawn value for the electric actuator at each of the one or more discrete positions between the fully open and fully closed states of the door, the reference current drawn value being indicative of an obstruction free operation of the door;

indicating a potential obstruction when the instantaneous current drawn value exceeds the reference current drawn value by a pre-determined threshold at any of the discrete positions of the door between the fully open and fully closed states; and altering the pre-determined threshold at each of the one or more discrete positions between the fully open and the fully closed states based on the life of the door, the life of the electric door actuator, the life of a vehicle in which the door is disposed, or a last performed maintenance cycle.

9. The method of claim 8, wherein the door is on a transit vehicle and comprises plural linked door panels.

10. The method of claim 8, further comprising altering a direction of movement of the door when the potential obstruction is indicated.

11. A method for detecting an obstruction against a door, the method comprising the steps of:

sensing an instantaneous current drawn value by an electric door actuator during movement of the door at one or more discrete positions between fully open and fully closed states of the door;

comparing the instantaneous current drawn value against a reference current drawn value for the electric actuator at each of the one or more discrete positions between the fully open and fully closed states of the door, the reference current drawn value being indicative of an obstruction free operation of the door;

indicating a potential obstruction when the instantaneous current drawn value exceeds the reference current drawn value by a threshold at any of the discrete positions of the door between the fully open and fully closed states; and altering the number of discrete positions between the fully open and the fully closed states of the door.

12. The method of claim 11, wherein the door is on a transit vehicle and comprises plural linked door panels.

13. The method of claim 11, further comprising altering a direction of movement of the door when the potential obstruction is indicated.

14. A system for determining an obstruction against a door, comprising:

one or more sensors configured to sense an instantaneous current drawn value by an electric actuator at one or more discrete positions when the door moves between a fully open state and a fully closed state;

a storage medium configured to store a reference current drawn value at each of the one or more discrete positions when the door moves between the fully open state and the fully closed state; and a digital processing unit configured to alter the reference current drawn value at each of the one or more discrete positions when the door moves between the fully open state and the fully closed state and when movement of the door is determined to be obstruction free;

wherein the digital processing unit is configured to determine potential obstruction by comparing the instantaneous current drawn value and the reference current drawn value.

15. The system of claim 14, further comprising:

a control unit configured to alter a direction of movement of the door when the potential obstruction is determined.

16. The system of claim 14, wherein the door is on a transit vehicle and comprises plural linked door panels.

17. A method comprising:

sensing current drawn by an electric door actuator during obstruction-free movement of a door between fully open, intermediate, and fully closed positions of the door;

storing, as a profile in memory, values of the sensed current at the positions;

altering the profile to add offset currents to the stored values; and in a subsequent movement operation of the door after the profile is altered, indicating a potential obstruction of the door responsive to a sensed current drawn by the electric door actuator during the subsequent movement operation exceeding the offset current for a given position of the door.

18. The method of claim 17, further comprising altering a direction of movement of the door responsive to the potential obstruction being indicated.

19. The method of claim 18, wherein the door is on a transit vehicle and comprises plural linked door panels.

20. The method of claim 17, further comprising adjusting the offset currents based on one or more of a life of the door, a life of the electric door actuator, a life of a vehicle in which the door is disposed, or a last performed maintenance cycle.

* * * * *